United States Patent [19]

Laird, Jr.

[11] 4,138,910

[45] Feb. 13, 1979

[54] CLEATED CHAIN WRENCH

[76] Inventor: Jonathan L. Laird, Jr., 50 E. First Ave., Parkesburg, Pa. 19363

[21] Appl. No.: 840,618

[22] Filed: Oct. 11, 1977

[51] Int. Cl.[2] ..... B25B 13/52

[52] U.S. Cl. ..... 81/67 R; 81/68

[58] Field of Search ..... 81/64, 66 R, 67 R, 68, 81/69, 70, 3.43

[56] References Cited

U.S. PATENT DOCUMENTS 1,860,012 5/1932 Carpenter ..... 81/67 R

*Primary Examiner*—James L. Jones, Jr.

*Attorney, Agent, or Firm*—Dann, Dorfman, Herrell and Skillman

[57] ABSTRACT

A chain wrench has a handle having a chain element pivoted to the handle by a pair of links to permit passage of the free end of the chain between the links, whereby the chain may be wrapped in full circumscribing relation to a workpiece. The handle has a camming surface and teeth elements positioned to confront the exposed surface of the chain when it is wrapped around the workpiece. The chain has a cleated surface on one side and has a smooth surface on the opposite side. In one mode of operation, the cleated surface confronts the workpiece to engage the same, whereby the cam surface causes the cleats to grip the workpiece and anchor the chain at that point when said handle is actuated to apply torque to the workpiece, the smooth surface permitting the chain to slide over said camming surface prior to applying torquing action upon said handle to afford snug engagement of the chain about substantially the entire circumference of the workpiece. In another mode of operation, the smooth surface of the chain confronts the workpiece and the cleated surface is exposed when it is wrapped around the workpiece. The teeth elements of the handle engage the cleated surface of the chain so that the cleats mesh with the teeth of the handle to tighten the chain around the workpiece when the handle is actuated to apply torque to the workpiece. The chain may be either a link-type chain having metallic links, or a strap of textile material which may be used when the workpiece has a high finish which may be easily damaged by either surface of the chain. Preferably, the wrench provides two chain elements which may be used interchangeably.

5 Claims, 5 Drawing Figures

FIG. 1
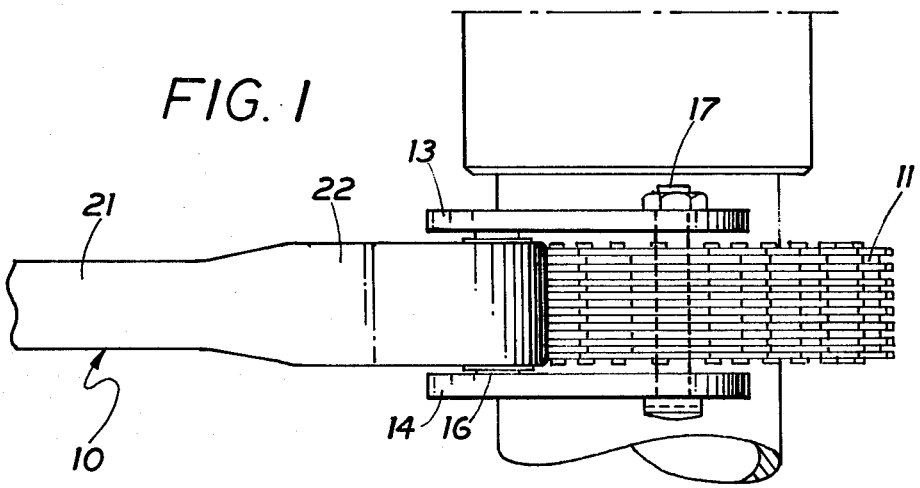
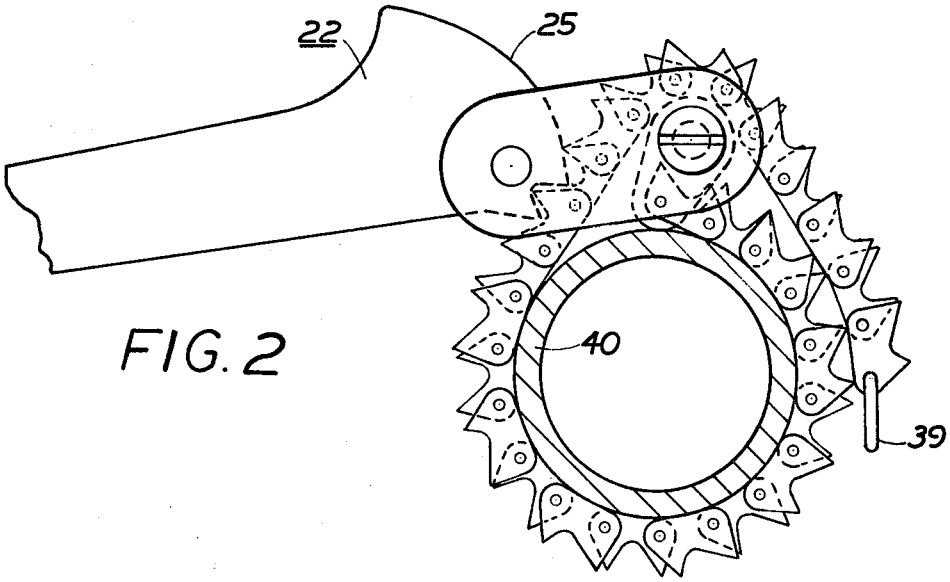
FIG. 2
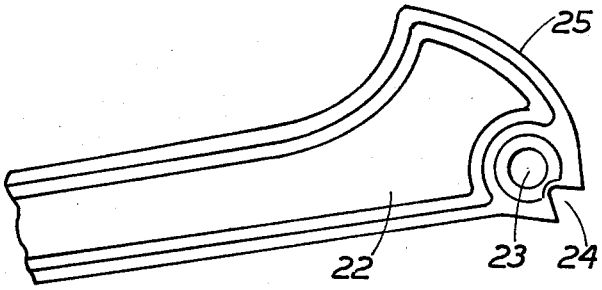
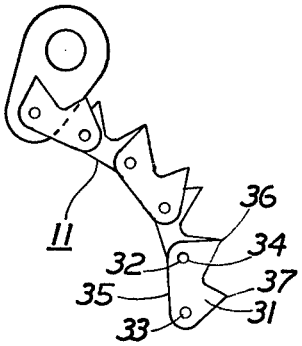
FIG. 3

CLEATED CHAIN WRENCH

The present invention relates to improvements in wrenches and more specifically to wrenches of the type shown in my prior U.S. Pat. No. 3,288,001, which affords a positive grip uniformly around an article for applying torque thereto, regardless of the article's external shape since the specific structure of the wrench insures positive engagement of the article to which the wrench is applied.

As is well known to those skilled in the art, the use of large pipe wrenches or heavy monkey wrenches on pipes and their associated fittings oftentimes distorts, warps or crushes the pipe or fitting to where it may not be capable of further use. Further, many times it is desired to use a heavy wrench on a pipe or fitting in a difficult location, such as along the sides of walls, floors or in corners, and the size of the wrench necessary to obtain a firm grip upon the pipe or fitting makes it difficult to obtain a purchase on the fitting with a standard pipe wrench. Further, if it is desired to hold a pipe to prevent its turning within a fitting or the like, oftentimes the only place of obtaining a purchase on the pipe is on its threads, and a standard pipe wrench will ruin the threads.

My prior patented wrench applies uniform pressure on the greater part of the circumference of an article being gripped, thereby avoiding warping, distorting or crushing of the pipe or fitting, and may be used in difficult places such as on pipes or fittings located adjacent walls or in other difficult locations.

A primary object of the present invention is to provide an improved wrench of the stated type which is readily adapted to be used for a wide variety of workpieces ranging from workpieces of regular cylindrical form to workpieces of irregular periphery and ranging from workpieces having a hard indestructible surface to workpieces having a surface finish which is readily injured.

Specifically, the present invention provides a wrench having a work-engaging component which is adapted to be altered to accommodate to the characteristics of the workpiece. More specifically, the present invention provides a chain wrench of the type shown in my prior patent whose chain has a smooth surface on one side and cleats in the form of pointed teeth on the opposite side which may grip the workpiece around its entire circumference as set forth in my prior patent and yet is reversible so as to engage the workpiece with the smooth surface of the chain and yet may be operated to tighten the chain about the periphery of the workpiece so that the handle may be used to torque the workpiece as required.

The present invention provides a wrench which may be used one way to engage the workpiece with the pointed cleats and may be simply reversed to engage the workpiece with the smooth side.

Another object of the invention is to provide a wrench of the stated type in which the cleated chain is releasably mounted on the head so that it may be replaced by a cleated strap element for use with workpieces which are subject to being damaged by the chain.

The foregoing objects of the invention are achieved while providing a wrench which may be used in confined quarters and manipulated with great facility.

These and other objects of the invention are more fully set forth hereinafter with reference to the accompanying drawings, wherein:

FIG. 1 is a plan view of the head of a wrench showing the chain applied to a cylindrical workpiece;

FIG. 2 is a view in side elevation of the wrench shown in FIG. 1;

FIG. 3 is an exploded view showing the configuration of the wrench head and the chain element, respectively;

Figure 4:
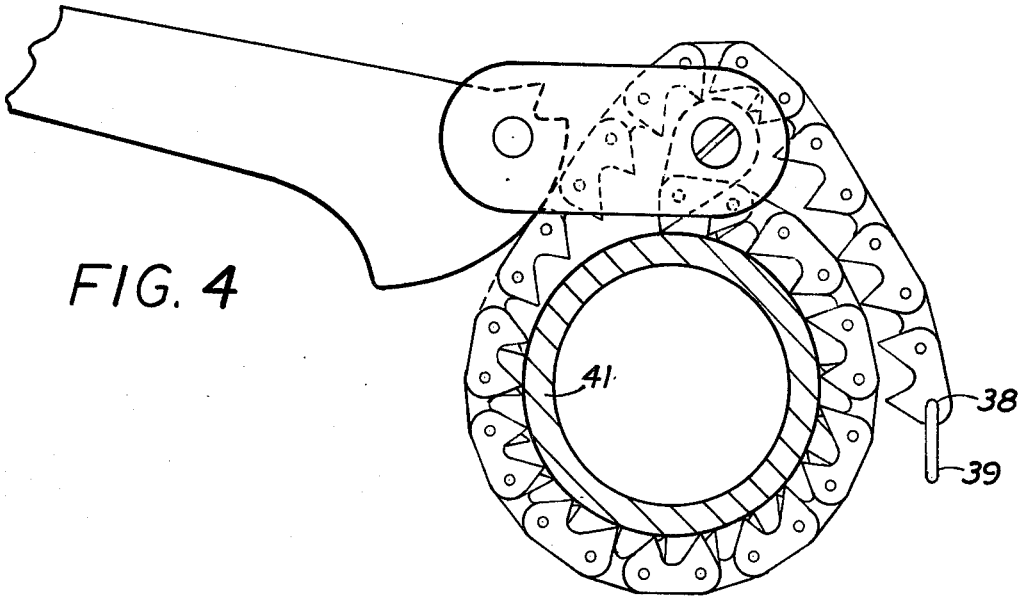
FIG. 4 is a view of the wrench head showing its use in an alternate mode of operation.

Referring to the drawings, a wrench is illustrated therein which comprises a handle member 10 and a work-engaging cleated chain element 11. The handle member is connected to the chain element 11 by a pair of connecting links 13 and 14. The links are pivoted to the handle by a pin 16 and are pivoted to the cleated element by a bolt 17. The spacing between the pin 16 and bolt 17 is sufficiently large to permit free passage of the cleated element between the handle and the bolt 17, as shown in FIG. 2.

The handle element 10 comprises an elongated grip portion 21 and an enlarged head portion 22. The pin 16 passes through a bore 23 in the enlarged head portion 22 which is disposed closely adjacent to one surface of grip portion 21 but offset from its center line. The head portion has a width larger than the grip portion so as to provide an elongated bearing surface within the bore provided for the pin 16. At the end of the head portion remote from the grip portion, radial to the bore 23, the head is provided with a plurality of teeth 24, and the end surface of the head portion is provided with a convex arcuate camming surface 25. In the present instance, the camming surface 25, in the area above the bore for the pin 16 (see FIG. 3), has a uniform radius of curvature approximately one-fifth of the axial length of the gripping portion 21 and the surface merges into the teeth 24 of the head portion 22.

The link-type chain element 11 comprises a plurality of link plates 31 (see FIG. 3), each of which has a pair of apertures 32 and 33 therein for receiving link pins 34. As shown in FIG. 1, the link plates 31 are interdigitated along the length of the pins 34, so that each pin 34 passes alternately through the forward apertures 33 of the rearwardly disposed link plates 31, and the rearward apertures 32 of the forwardly disposed link plates 31. As shown, between the apertures 32 and 33, the link plates are rounded on one surface to provide a smooth back portion 35 and are toothed on the other surface as indicated at 36 and 37. When mounted on the pins 34, the forward teeth 37 of the rearward link plates align with the rearward teeth 36 of the forward link plates to provide a transverse cleat extending across the full width of the chain element 11. As shown in FIGS. 2 and 3, the chain element 11 provides a series of cleats corresponding in number to the number of link pins 34. In the mode of operation shown in FIGS. 1–3, the smooth back portions 35 of the links 31 bear against the workpiece 40 and when wrapped around the workpiece and between the connecting links 13 and 14 provide substantially full circumferential engagement of the chain about the workpiece. The chain is made in any desired length and preferably the end pin 38 is formed into a pilot loop 39 to assist in manipulating the chain.

In accordance with the invention, with the chain wrapped around the workpiece with the smooth back against the workpiece, the cleats formed by the teeth 36 and 37 are on the exposed surface of the chain and are free to be engaged by the teeth 24 of the wrench head. To this end, the teeth 24 have a configuration which forms a recess therebetween which conforms to the sharpened outline of the teeth 36 and 37. Prior to applying the torquing force on the wrench head, the handle may be lifted so as to pivot on the pin 16 and permit the teeth 24 to engage the cleats of the chain in the part where the smooth backs of the link plates rest against the workpiece 40. Thereafter, when torquing force is applied to the handle tending to rotate the same counterclockwise about the pivot pin 16, the counterclockwise rotation causes the teeth 24 to act as a gear and to displace the chain circumferentially clockwise about the workpiece so as to tighten the chain circumferentially about the workpiece against the retained pressure provided by the connecting links 13 and 14 at the opposite captive end of the chain. If it is desired to increase the engagement of the teeth 24 with the cleats of the chain 11, the free end of the chain may be drawn back over the camming surface 25.

The free end of the chain passes through the opening between the head 22 and the bolt 17. The link-type chain conforms to the periphery of the element 40 and the gear action provided by the rotation of the teeth 24 exerts sufficient tension on the chain to firmly grip the workpiece 40 about the entire circumference and anchor the wrench thereto by means of the smooth backs 35 of the links 31. With the wrench thereby firmly engaged, further torquing force on the wrench permits the workpiece to rotate about its center.

In an alternate mode of operation, the wrench may be reversed by simply turning it over as shown in FIG. 4 so that the cleated side of the chain faces the workpiece and the smooth side face is exposed to the cam surface 25, the captive end of the chain being retained by the bolt 17 and the free end of the chain passing between the head 22 and the bolt 17. In this mode of operation, the captive end of the chain is retained by the bolt 17 and the free end of the chain passes between the head 22 and the bolt 17. Counterclockwise torquing pressure applied to the handle 10 tends to cause the camming surface 25 to bear against the smooth backs 35 of the links 31 where the cleated surface of the chain engages the workpiece 41. The torquing pressure on the wrench thereby tends to cause the cleats formed by the sharpened teeth 36 and 37 to bear into the workpiece 41 and become firmly anchored at that point. Further counterclockwise pressure thereby rocks the pin 16 towards the left, applying tangential pressure on the chain through the bolt 17 so as to tighten the teeth 36 and 37 about the entire circumference of the workpiece 41. When the chain is sufficiently tightened to provide a firm gripping of the workpiece around substantially the entire periphery of the workpiece, further torquing pressure causes the workpiece to rotate counterclockwise about its center. It should be noted that this torquing action is the same desirable torquing action which was achieved by the construction of my prior U.S. Pat. No. 3,288,001.

Figure 5:
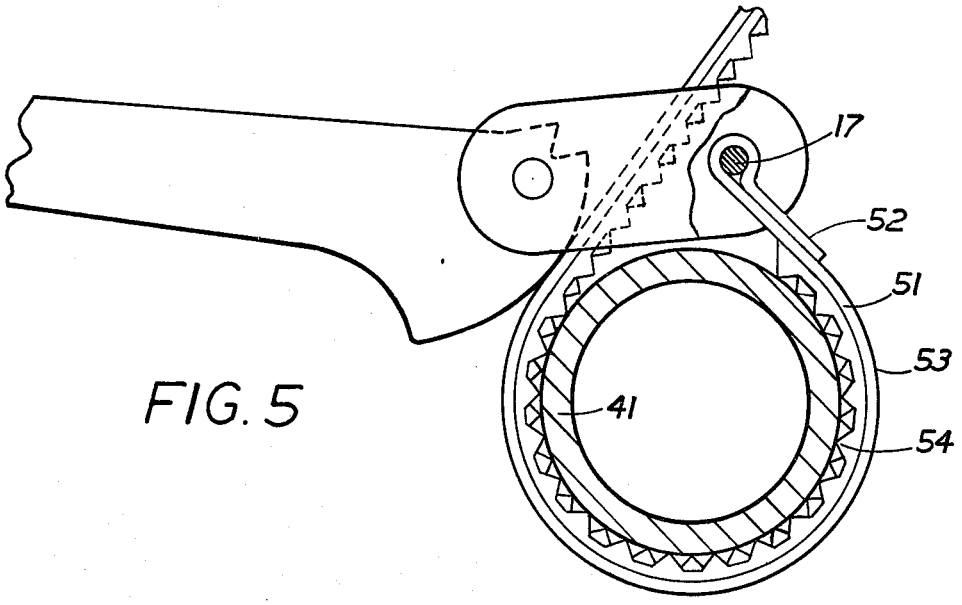
FIG. 5 is a view similar to FIG. 4 showing the link-type chain replaced by a cleated strap element in accordance with the present invention.

In both of these foregoing modes of operation, the flexible nature of the chain affords ready conformation of the chain to the outer periphery of the workpiece regardless of whether the workpiece is a regular cylindrical configuration as shown in the drawings or is of irregular configuration. The gripping action assures that when the wrench is applied to the workpiece, the chain obtains purchase on the workpiece without lost motion. The absence of lost motion avoids scuffing the surface of the workpiece. In the first mode, the point of purchase is adjacent the bolt 17, whereas in the second mode of operation, the point of purchase is underlying the cam surface 25. Once the chain achieves its purchase on the workpiece, torquing the wrench simply applies the necessary direction of torque to the workpiece. This permits the wrench to be used in confined areas where there is not sufficient freedom of movement to allow the lost motion which is inherent in standard type wrenches. Furthermore, the thickness of the chain and the fact that it is wrapped circumferentially about the entire circumference of the workpiece permits the wrench to be applied where the workpiece is disposed close against the wall or other hard place. When applying the chain to the workpiece, the free end of the chain may be simply threaded between the workpiece and the wall and then wrapped around the workpiece and up into the space between the head and the bolt 17. Following this operation, the point of purchase is determined and the chain is snugly engaged against the workpiece and the force is applied to properly grip the workpiece and apply the torque thereto.

Where the workpiece has a surface finish which may be damaged or marred by contact with a metallic link-type chain, the wrench of the present invention permits substitution of a strap for the link-type chain. The strap is preferably an elongated textile fabric or webbing which has a plastic layer on at least one surface, constituting a flexible chain member. As shown in FIG. 5, the one surface of the strap is formed with cleats to provide a desirable frictional engagement with the workpiece when the cleats are disposed against the workpiece as shown and may also be used to mesh with the teeth 24 when the strap is wrapped counterclockwise. Specifically, as shown in FIG. 5, the wrench handle and links are identical to the handle 10 and links 13 and 14, and the bolt 17 is removed to permit the strap chain element 51 to be engaged on the bolt 17 in place of the link-type chain element 11. As shown, the strap element 51 is folded back on itself around the bolt 17 as indicated at 52 to provide a pivotal connection which enables the flexible strap to wrap itself around the workpiece. The strap is preferably a flexible strap having a smooth body portion 53 on one surface and cleats formed integrally on the other surface indicated at 54. In this fashion, the strap element is functionally comparable to the link-type chain 11 described in the previous embodiment.

The present invention constitutes an improvement on the wrench of my U.S. Pat. No. 3,288,001 which enables the wrench to be used either with the sharpened teeth of the chain engaging the work, or with the smooth side of the chain engaging the work. Alternatively, the link-type chain may be removed and replaced with a strap which is the functional equivalent of the link-type chain. Thus, the present invention provides a diversely operable wrench having all of the desirable characteristics of my previously patented wrench, and is adaptable for use in situations where my earlier wrench would be impractical.

While a particular embodiment of the present invention has been herein illustrated and described, it is not intended to limit the invention to such disclosure, but changes and modifications may be made therein and thereto within the scope of the following claims.

I claim:

1. A wrench comprising a handle having an enlongated grip portion and an enlarged head portion, spaced parallel link elements pivoted to said handle by a pivot pin passing through said enlarged head portion, a fastener at the remote end of said link elements disposed in spaced relation to said head portion, a chain element pivoted on said fastener between said links and having a free end portion adapted to pass between said links in the space between said fastener and said head portion, whereby the chain may extend from said remote fastener in full circumscribing relation to a workpiece and pass between said handle and said remote fastener, said chain comprising parallel pointed cleats extending transversely the full width of the chain on one surface thereof and a smooth back on the other surface thereof, a camming surface on said head portion remote from the pivot pin mounting said links and positioned to confront the exposed surface of the chain when it is wrapped around the workpiece in one direction with the cleats engaging the workpiece and said camming surface operable to bear against the smooth back of the chain in the portion of the chain circumscribing said workpiece to thereby securely anchor the chain against the workpiece, said camming surface being convex and of sufficient length to permit said camming surface to be the sole anchoring means for said wrench upon torque being applied to workpieces having differing diameters, said head portion including a plurality of teeth centered about the pivot pin for said link elements and projecting radially outward to confront the cleated surface of the chain when it is wrapped around the workpiece in the opposite direction with the smooth sides of the chain bearing against the workpiece, said teeth meshing with said cleats to securely tighten the chain around said workpiece upon application of torque by said handle, whereby said wrench is operable to engage the workpiece either with the pointed teeth of the cleated side or with the smooth surface of the smooth side.

2. A wrench according to claim 1 wherein said chain is a link-type chain comprising transverse rows of link plates having link pins connecting the link plates to each other in rows, said link plates of each row being interdigitated with respect to the link plates of an adjacent row, each of said link plates having a pair of teeth disposed on the same side of the plate and a rounded back portion on the opposite side of said plate forming the smooth back surface of the chain, the teeth of said interdigitated link plates being aligned transversely to form said pointed cleats across the full width of the chain, when the chain is wrapped around the workpiece in one direction, said camming surface operable to bear against the smooth side of the chain links, and when the chain is wrapped around the workpiece in the opposite direction, said teeth of the head portion meshing with the teeth of the interdigitated link plates.

3. A wrench according to claim 1 wherein said chain is woven textile flexible strap element having a smooth surface on one side and a layer of plastic material forming cleats on the other side, said cleats conforming to the teeth of said head portion.

4. A wrench according to claim 1 wherein said remote fastener is a releasable fastener operable to selectively fasten a chain element to said parallel link elements.

5. A wrench according to claim 1 wherein said convex camming surface has a uniform radius of curvature approximately one-fifth of the axial length of the handle gripping portion.

* * * * *